United States Patent [19]

Choy et al.

[11] 4,310,434

[45] Jan. 12, 1982

[54] POLY(ETHYLENE OXIDE) COMPOSITIONS WITH CONTROLLED SOLUBILITY CHARACTERISTICS

[75] Inventors: Clement K. Choy, Danville, Calif.; Robert A. Greene, Cincinnati, Ohio

[73] Assignee: The Procter & Gamble Company, Cincinnati, Ohio

[21] Appl. No.: 153,993

[22] Filed: May 28, 1980

[51] Int. Cl.[3] ..... C11D 1/83; C11D 3/37

[52] U.S. Cl. ..... 252/174.21; 252/174; 252/174.23; 260/37 AL; 525/3

[58] Field of Search ..... 252/174.23, DIG. 16, 252/174.21; 260/37 AL; 525/3

[56] References Cited

U.S. PATENT DOCUMENTS

| | | | |
|---|---|---|---|
| 3,331,780 | 7/1967 | Krusius | 252/135 |
| 3,897,357 | 7/1975 | Carmello et al. | 252/106 |
| 3,936,385 | 2/1976 | Cheng | 252/99 |
| 3,944,663 | 3/1976 | Weiss et al. | 424/78 |
| 3,959,176 | 5/1976 | Mahn et al. | 252/352 |
| 4,119,578 | 10/1978 | Daeninckx et al. | 252/548 |
| 4,148,743 | 4/1979 | Schubert | 252/132 |

FOREIGN PATENT DOCUMENTS

53/58507 5/1978 Japan .

OTHER PUBLICATIONS

Union Carbide, Bulletin F-42933, pp. 3-10, Union Carbide Corp., New York, 1970.

Union Carbide, Bulletin 40246-C, pp. 1-21, Union Carbide Corp., New York, 1964.

Union Carbide, "Poly OX", pp. 9 & 10, Union Carbide Corp., New York, 1973.

*Primary Examiner*—Earl A. Nielsen

*Attorney, Agent, or Firm*—Ronald L. Hemingway; Richard C. Witte

[57] ABSTRACT

Solid cake compositions comprising poly(ethylene oxide), surfactant and water-soluble salt. The compositions have controlled solubility characteristics, thereby reducing the tendency of the resin to form a gel when the cake is contacted with water. The cakes are useful in dispensers which are employed in the flush tank of a toilet to automatically dispense chemicals to the flush water.

7 Claims, No Drawings

POLY(ETHYLENE OXIDE) COMPOSITIONS WITH CONTROLLED SOLUBILITY CHARACTERISTICS

TECHNICAL FIELD

The present invention relates to cake compositions which are useful for the treatment of the flush water of toilets in order to reduce the tendency of such flush water to produce aerosolization during the flushing of the toilet. The compositions comprise a poly(ethyleneoxide)resin, a surfactant and a water-soluble salt, and are formulated so as to avoid excessive amounts of gelling when used in certain types of dispensing means for automatic dispensing of chemicals into the toilet flush tank.

BACKGROUND ART

The reduction of aerosolization produced by the flushing of toilets is desirable in order to reduce the possibility of airborne transmission of disease organisms from the toilet wastewater. In the application of McCune, U.S. Ser. No. 959,405, filed Nov. 9, 1978, and incorporated by reference herein, it is disclosed that the aerosolization of wastewater from flushing toilets can be significantly reduced by the presence of low levels (1–30 ppm) of high molecular weight poly(ethylene oxide) resins in the wastewater.

In treating toilet flush water with chemicals in order to produce desirable effects such as bowl cleaning, disinfection, deodorization, aerosol reduction etc., it is desirable that the chemicals be dispensed into the flush water automatically each time the toilet is flushed. The prior art discloses numerous devices which have been designed for this purpose. Exemplary of such devices are those disclosed in U.S. Pat. Nos. 3,831,205, issued Aug. 27, 1974 to Foley, 3,341,074 issued Sept. 12, 1967 to Pannutti, 3,504,384 issued Apr. 7, 1970 to Radley et al, 2,688,754 Sept. 14, 1954 to Willits et al. and 4,036,407, issued July 19, 1977 to Slone. Particularly desirable devices are those wherein the chemical composition is in the device in the form of a solid cake composition. In this type of device a measured amount of water enters the device during one flush cycle and remains in contact with the cake composition between flushes, thereby forming a concentrated solution of the composition which is dispensed into the flush water during the next flush. Obvious advantages of such devices are that the chemical composition can be packaged and shipped in more concentrated form than an aqueous solution of the chemicals, and the problems of liquid spillage resulting from breakage of the dispensers during shipment or handling is eliminated. Especially preferred devices for automatic dispensing of chemicals from solid cake compositions into the toilet are those described in U.S. Pat. No. 4,171,546 of Dirksing, issued Oct. 23, 1979, U.S. Pat. No. 4,208,747 of Dirksing, issued June 24, 1980, and U.S. Pat. No. 4,186,856 of Dirksing, issued Feb. 5, 1980, all of said patents being incorporated herein by reference.

It has been found that when solid cake compositions comprising high molecular weight poly(ethylene oxide) resins (i.e. molecular weights of from about 500,000 to about 7,000,000) are utilized in automatic dispensers, the resin forms a thick gel when exposed to the limited volume of water within the dispenser, thereby retarding or even completely blocking the subsequent flow of dissolved materials out of the dispenser and into the flush water.

It is an object of the present invention to provide solid cake compositions comprising poly(ethylene oxide)resins, which compositions are suitable for use in dispensers for automatically dispensing chemicals into the toilet.

It is a further object of the present invention to provide solid cake compositions comprising poly(ethylene oxide) resins which compositions have a reduced tendency to form gels when exposed to water.

SUMMARY OF THE INVENTION

The present invention relates to solid cake compositions having controlled solubility characteristics.

The compositions comprise:

(1) from about 1% to about 20% of a poly(ethyleneoxide) resin having a molecular weight from about 500,000 to about 7,000,000;

(2) an alkali metal sulfate salt or mixture of said salts in a weight ratio of at least about 2.5:1 of alkali metal sulfate salt to resin; and (3) an organic surfactant in a weight ratio of surfactant to alkali metal sulfate salt of from about 0.5:1 to about 2:1.

DISCLOSURE OF INVENTION

According to the present invention it has been found that by combining poly(ethylene oxide) resins (hereinafter also referred to as PEO resins) with certain types of surfactants and water-soluble salts in certain proportions, compositions are obtained wherein the tendency of the resin to gel upon exposure to water is greatly reduced, thereby facilitating the dispensing of said resins into toilet flush water from automatic dispensing devices.

The compositions of the present invention are in the form of solid cakes and comprise:

(1) From about 1% to about 20% (preferably 5% to 12%) of a poly(ethylene oxide) resin having a molecular weight of from about 500,000 to about 7,000,000;

(2) An alkali metal sulfate salt in a weight ratio of at least from 2.5:1 of said salt to said resin;

(3) An organic surfactant in a weight ratio of surfactant to alkali metal sulfate salt (Component 2) of from about 0.5:1 to about 2.1.

All percentages and ratios recited herein are "by weight" unless otherwise specified.

The resin in the compositions herein when present in the water in the toilet bowl at levels of at least about 0.1 ppm or more, preferably greater than about 1 ppm, and most preferably about 4 to 15 ppm, significantly reduces the tendency for aerosol formation during the flushing of the toilet. The alkali metal sulfate salt reduces gelling of the resin in the dispensing device from which the resin is advantageously dispensed into the toilet tank flush water. it is believed that the alkali metal sulfate operates by suppressing the solubility of the resin, thereby also suppressing gelation of dissolved resin. The surfactant is believed to provide controlled solubilization of the salt-insolubilized resin. When the resin is combined with the alkali metal sulfate and surfactant in the manner described herein, a composition is obtained which provides sufficient solubilization of the resin to produce the required concentration of resin in solution for dispensing into the flush water, and at the same time avoids excessive gelling of the resin, which can clog the dispenser used for automatically dispensing the solution of resin into the flush water.

The poly(ethylene oxide) resins of the present invention are polymers of ethylene oxide having average molecular weights of from about 500,000 to 7,000,000. The preferred molecular weight range is from about 1,000,000, to about 7,000,000. These polymeric resins are commercially available under the trade name Polyox$^R$ from Union Carbide Corporation. They can be prepared by the polymerization of ethylene oxide, utilizing an alkaline earth metal oxide as catalyst. The amount of PEO resin in the compositions herein can be from about 5% to about 20%, preferably from about 8% to 12%.

The alkali metal salts used in the present invention are the sulfate salts of the Group 1A metals of the Periodic Table. The preferred sulfates are sodium and potassium sulfate. The most preferred salt is sodium sulfate. Mixtures of alkali metal sulfate salts can be used.

The ratio of alkali metal sulfate salt to resin in the compositions herein is preferably from about 2.5:1 to about 6:1, most preferably about 3.5:1. Ratios in excess of 10:1 can be used. Excessive amounts of salt, however, can adversely affect the ability of the surfactant to carry out its solubilizing and dispersing function. Accordingly the amount of alkali metal sulfate salt must also be chosen in relation to the amount of surfactant in the formula. Preferably the amount of alkali metal salt will not exceed twice the amount of surfactant. In general, the ratio of surfactant to alkali metal salt will be from about 0.5 to 1 to 2:1.

The Surfactant

The third essential component of the composition herein is an organic surfactant. Anionic, nonionic, ampholytic, zwitterionic or cationic surfactants can be used. The surfactant or surfactant mixture should be solid at ambient temperature, i.e. temperatures up to about 100° F. Anionics and nonionics and mixtures thereof are preferred. Anionics are the most preferred.

The anionic surfactants can be broadly described as the water-soluble salts, particularly the alkali metal salts, of organic sulfuric acid reaction products having in their molecular structure an alkyl or alkaryl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the anionic surfactants which can be employed in the practice of the present invention are the sodium or potassium alkyl sulfates, especially those obtained by sulfating the higher alcohols ($C_8$–$C_{18}$ carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); sodium or potassium alkyl naphthalene sulfonates containing one or two alkyl groups of 1 to about 6 carbon atoms each; paraffin sulfonate surfactants having the general formula $RSO_3M$, wherein R is a primary or secondary alkyl group containing from about 8 to about 22 carbon atoms (preferably 10 to 18 carbon atoms) and M is an alkali metal, e.g., sodium or potassium; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 10 moles of ethylene oxide; sodium or potassium salts of alkyl phenol ethylene oxide ether sulfates with about 1 to about 10 units of ethylene oxide per molecule and in which the alkyl radicals contain from about 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil, and sodium or potassium $\beta$-acetoxy- or $\beta$-acetamido-alkane-sulfonates where the alkane has from 8 to 22 carbon atoms.

Nonionic surfactants which can be used in practicing the present invention can be of three basic types—the alkylene oxide condensates, the amides and the semipolar nonionics.

The alkylene oxide condensates are broadly defined as compounds produced by the condensation of alkylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble-compound having the desired degree of balance between hydrophilic and hydrophobic elements.

Examples of such alkylene oxide condensates include:

1. The condensation products of aliphatic alcohols with ethylene oxide. The alkyl chain of the aliphatic alcohol can either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 mols of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the abovedescribed coconut alcohol. Examples of commercially available nonionic surfactants of this type include Tergitol 15-S-9 marketed by the Union Carbide Corporation, Neodol 23-6.5 marketed by the Shell Chemical Company and Kyro EOB marketed by The Procter & Gamble Company.

2. The polyethylene oxide condensates of alkyl phenols. These compounds include the condensation products of alkyl phenols having an alkyl group containing from about 6 to about 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-610 marketed by the GAF Corporation; and Triton X-45, X-114, X-100 and X-102, all marketed by the Rohm and Haas Company.

3. The condensation products of ethylene oxide with a hydrophobic base formed by the condensation of propylene oxide with propylene glycol. The hydrophobic portion of these compounds has a molecular weight of from about 1500 to 1800 and of course exhibits water insolubility. The addition of polyoxyethlene moieties of this hydrophobic portion tends to increase the water-solubility of the molecule. Examples of compounds of this type include certain of the commercially available Pluronic surfactants marketed by the Wyandotte Chemicals Corporation.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2500 to about 3000. This base is condensed with ethylene oxide to the extent that the condensation products contains from about 40% to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

Examples of the amide type of nonionic surfactants include the ammonia, monoethanol and diethanol amides of fatty acids having an acyl moiety of from about 8 to about 18 carbon atoms. These acyl moieties are normally derived from naturally occurring glycerides, e.g., coconut oil, palm oil, soybean oil and tallow, but can be derived synthetically, e.g., by the oxidation of petroleum, or by hydrogenation of carbon monoxide by the Fischer-Tropsch process.

Examples of the semi-polar type of nonionic surfactants are the amine oxides, phosphine oxides and sulfoxides. These materials are described more fully in U.S. Pat. No. 3,819,528, Berry, issued June 25, 1974, and incorporated herein by reference.

Many nonionic surfactants are liquids at ambient temperatures, thus it may be necessary to combine them with solid surfactants in order to formulate them into the solid cake compositions herein.

Ampholytic surfactants which can be used in practicing the present invention can be broadly described as derivatives of aliphatic amines which contain a long chain of about 8 to about 18 carbon atoms and an anionic water-solubilizing group, e.g., carboxy, sulfo and sulfato. Examples of compounds falling within this definition are sodium-3-dodecylamino-propionate, sodium-3-dodecylamino propane sulfonate, and dodecyl dimethylammonium hexanoate.

Zwitterionic surfactants which can be used in practicing the present invention are broadly described as internally-neutralized derivatives of aliphatic quaternary ammonium and phosphonium and tertiary sulfonium compounds, in which the aliphatic radical can be straight chain or branched, and wherein one of the aliphatic substituents contains from about 8 to about 18 carbon atoms and one contains an anionic water-solubilizing group, e.g., carboxy, sulfo, sulfato, phosphato, or phosphono.

Cationic surfactants which can be used in practicing the present invention include stearyl dimethyl benzyl ammonium chloride, coconut dimethyl benzyl ammonium chloride, cetyl pyridinium chloride and cetyl trimethyl ammonium chloride.

Particularly preferred surfactants for use herein are sodium and potassium alkyl naphthalene sulfonates having one or two alkyl groups containing from 1 to about 6 carbons each, and paraffin sulfonates having the formula $RSO_3M$, wherein R is a primary or secondary alkyl group containing from about 8 to about 22 carbon atoms (preferably about 12 carbon atoms), and M is an alkali metal.

The use of naphthalene sulfonates in the formulation of cake compositions of the type encompassed by the present invention is described in the concurrently filed application of Choy, entitled "SURFACTANT CAKE COMPOSITIONS", U.S. Ser. No. 154,000 filed May 28, 1980, now U.S. Pat. No. 4,278,571, issued July 14, 1981, by reference herein.

Optional Materials

Various optional materials may be included in the compositions herein.

Dyes may be included at levels of from about 2.5% to 10%. Examples of suitable dyes are Alizarine Light Blue B (X.I. 63010), Carta Blue VP (C.I. 24401), Acid Green 2G (C.I. 42085), Astragon Green D (C.I. 42040), Supranol Cyanine 7B (C.I. 42675), Maxilon Blue 3RL (C.I. Basic Blue 80), Drimarine Blue Z-RL (C.I. reactive Blue 17), Alizarine Light Blue H-RL (C.I. Acid Blue 182), FD & C Blue No. 1 and FD & C Green No. 3 (See the applications of Kitko, U.S. Ser. No. 972,318 filed Dec. 22, 1978 and U.S. Ser. No. 915,027, filed June 12, 1978, both incorporated by reference herein. C.I. refers to The Color Index.

Partially hydrolyzed polyacrylamides or copolymers of ethylene and maleic anhydride at levels of from about 5% to about 30% are desirable components of the compositions herein when said compositions are used in conjunction with compositions which dispense hypochlorite bleach into the toilet flush water. These polymers have been found to reduce the tendency of Mn (II) ions in the water to become oxidized to Mn (IV) by hypochlorite and stain in the toilet bowl. Exemplary hydrolyzed polyacrylamides are those sold under the names P-35 and P-70 by American Cyanamid Company, Wayne, New Jersey. P-35 has a molecular weight of about 7000 and P-70 has a molecular weight of about 2000. Both are about 80% hydrolyzed. Exemplary copolymers of ethylene and maleic anhydride are EMA-21 and EMA-31, which are available from Monsanto Co., St. Louis, Mo. The use of these materials in toilet bowl cleaning compositions is described in U.S. Ser. No. 028,612, Kurtz, filed Apr. 9, 1979; U.S. Ser. No. 028,613, Callicott, filed Apr. 9, 1979; and U.S. Ser. No. 028,293, Callicott, filed Apr. 9, 1979, now abandoned in favor of U.S. Ser. No. 234,535 filed Feb. 17, 1981, all incorporated by reference herein.

Alkali metal bromide (e.g. sodium bromide) is a particularly desirable component of the compositions herein when said compositions are used in conjunction with compositions which dispense hypochlorite bleach into the flush water. The bromide ion acts as an activator, to enhance the bleaching and sanitizing performance of the hypochlorite when the two are mixed together in the flush water. Generally the bromide salt will comprise from about 1% to 4% of the compositions herein.

Perfumes can be incorporated into the compositions herein at levels of from about 0.5% to about 20%, preferably from about 2% to 11%. As described in U.S. Pat. No. 4,246,129, Kacher, issued Jan. 20, 1981 (incorporated by reference herein), certain perfume materials can perform the added function of reducing the solubility of anionic sulfonate and sulfate surfactants used in the compositions herein, if this is desirable. Examples of such perfume materials are isobornyl acetate, myrtenyl acetate and fenchyl acetate.

Stabilizers for the PEO resins can be incorporated into the compositions herein to prevent degradation of the resin to lower molecular weight species. Such degradation is often caused by oxidation which is catalyzed by trace amounts of transition metal ions (e.g. iron or chromium) which are brought into the composition as contaminants in other materials such as the dyes, surfactants, etc. A preferred stabilizer is thiourea at a level of from about 1% to about 20% based on the weight of the resin.

Another desirable optional ingredient for the compositions herein is a fluorinated polyoxyethylene ethanol surfactant. An example of this type of material is Fluorad FC-170, sold by 3M Company, Minneapolis, Minn. 55101. The amount of fluorinated polyoxyethylene ethanol surfactant should be from about one tenth to about one thirtieth the amount of PEO resin in the composition. These fluorinated surfactants enhance the aerosol suppression performance of the PEO resins.

Dispensing Means

Dispensing means which can be used to dispense compositions of the present invention into the toilet flush water are exemplified by those described in U.S. Pat. No. 3,831,205, 3,341,074, 3,504,384, 2,688,754, 4,036,407, 4,171,546, 4,208,747 and 4,186,856. A particularly advantageous dispensing means for use with the compositions herein is described in the concurrently filed application of Choy entitled "PASSIVE DOSING DISPENSER EXHIBITING IMPROVED RESISTANCE TO CLOGGING," U.S. Ser. No. 153,997, filed May 28, 1980, incorporated by reference herein.

Although the cake compositions herein have a low tendency toward gel formation in dispensers designed for use in flush toilet tanks, they nevertheless do form some gel. Accordingly, it is preferable that they be used in a dispensing device which is especially designed to minimize any adverse effects on dispensing which may accompany even small amounts of gel formation by the compositions herein. The above-noted dispenser of Choy is such a device.

Composition Manufacture

The manufacture of solid cakes of the compositions herein is well within the capability of persons of ordinary skill in the tableting art. The composition components are mixed to form a homogeneous granular mass and this mass is formed into a cake of the desired dimensions by use of conventional stamping or pressing equipment.

The invention herein will be illustrated by the following examples.

EXAMPLE I

This example illustrates the ability of sodium sulfate, at appropriate sodium sulfate:resin ratios, to reduce the gelling of the resin when in contact with water. An objective measure of gelling is the amount of water absorbed by the resin.

Test Procedure:

(1) 5 grams of Polyox C, a granular poly (ethylene oxide) resin having a molecular weight of approximately $5\times10^6$, was weighed and mixed in a jar with the appropriate amount of sodium sulfate to give $Na_2SO_4$:resin weight ratios of 0:10, 2:10, 5:10, 10:10, 25:10 and 50:10, respectively.

(2) Each of the mixtures was placed in a tabletting cylinder of $1\frac{1}{8}$ inch inside diameter and compressed to a pressure of 5000 pounds per square inch with a manually operated hydraulic press (Carver Press—12 ton—Model C)

(3) The tablets were each immersed in 100 ml distilled water in a 150 ml beaker at room temperature (70°-75° F). for 72 hours. The gross weight of beaker plus water, before introduction of the tablet and after the tablet was removed, was recorded. The amount of water absorbed by the tablet was determined by difference. The amount of water absorbed is a measure of the amount of gelling which occurred.

The test was run on two different occasions, with three replicates each time the test was run.

The results are shown in the following table. Results are expressed as grams of water absorbed by the tablet.

TABLE I

| | A | B | C | D | E | F |
|---|---|---|---|---|---|---|
| Polyox C | 5 g | 5 g | 5 g | 5 g | 5 g | 5 g |
| $Na_2SO_4$ | 0 | 1 | 2.5 | 5 | 12.5 | 25 |
| Test 1 | | | | | | |
| Rep. 1 | 43 g | 44 g | 42 g | 31 g | 26 g | 28 g |
| Rep. 2 | 42 | 44 | 42 | 45 | 43 | 21 |
| Rep. 3 | 42 | 45 | 41 | 44 | 27 | 29 |
| Avg. | 42 | 44 | 42 | 40 | 32 | 26 |
| Test 2 | | | | | | |
| Rep. 1 | 53 | 53 | 60 | 57 | 45 | 30 |
| Rep. 2 | 48 | 51 | 47 | 56 | 47 | 35 |
| Rep. 3 | 53 | 54 | 51 | 53 | 46 | 36 |
| Avg. | 51 | 53 | 53 | 55 | 46 | 34 |

These data show a clear breakpoint in water absorption at about a 2.5:1 ratio of sodium sulfate:resin.

EXAMPLE II

A composition of the present invention was prepared according to the following procedure.

(1) All dry ingredients (i.e. all ingredients except the perfume and Fluorad FC-170) were weighed, placed in a Waring Blender, and mixed in the blender for 5-10 minutes to form a homogeneous mixture.

(2) The FC-170 and perfume were mixed together and added to the mixture in the blender and mixing was continued until the total mixture was judged to be homogeneous.

(3) 60 grams of the mixture was placed into a die box having a rectangular face dimension of 5 cm by 7 cm.

(4) Using a Stokes Press, a weight of 6 tons was applied to form a tablet.

| | |
|---|---|
| Polyox C[1] | 8.0% |
| $Na_2SO_4$ | 30.0 |
| Thiourea | 1.0 |
| Fluorad FC-170[2] | 0.25 |
| Petro BAF[3] | 43.15 |
| Perfume | 9.0 |
| Acid Green[3] | 5.7 |

-continued

| | |
|---|---|
| NaBr | 2.9 |
| | 100.0 |

[1]PEO resin, M.W. 5,000,000 (Union Carbide Co.)
[2]Fluorinated alkyl polyoxyethylene ethanol (3-M Company)
[3]99+% active sodium lower alkyl ($C_2$-$C_4$) naphthalene sulfonate (Petrochemicals Co., Inc.)

After stamping, this composition had dimensions of 5 cm×7 cm×1.2 cm.

The tablet is placed in an automatic dispensing device of the general type described in the concurrently filed application of Choy, U.S. Ser. No. 153,997 filed May 28, 1980, and the device is suspended in the flush tank of a toilet, using a hanger device of the type described in U.S. Pat. No. 4,247,070 of Dirksing issued Jan. 27, 1981 and incorporated by reference herein. The device operates satisfactorily, i.e. it repeatedly delivers metered amounts of a solution of the composition of this example to the flush water without interference with the functioning of the dispenser due to gel formation.

What is claimed is:

1. A composition of matter in solid cake form, said composition comprising:

A. from about 8% to about 20% of a poly(ethylene oxide resin having a molecular weight from about 500,000 to about 7,000,000;

B. an alkali metal sulfate salt or mixture of said salts in a weight ratio of at least about 2.5:1 of alkali metal sulfate salt to resin; and C. an organic surfactant in a weight ratio of surfactant to alkali metal sulfate salt of from about 0.5:1 to about 2:1.

2. The composition of claim 1 wherein Component A is present at a level of from about 8% to about 12%.

3. The composition of claim 2 wherein Component B is selected from the group consisting of sodium sulfate, potassium sulfate and mixtures thereof.

4. The composition of claims 1, 2 or 3 wherein the ratio of Component B to Component A in said composition is from about 2.5:1 to about 6:1.

5. The composition of claim 4 wherein Component B is sodium sulfate.

6. The composition of claim 5 wherein the surfactant is selected from the group consisting of anionic and nonionic surfactants, and mixtures thereof.

7. The composition of claim 6 wherein the surfactant is an anionic surfactant.

* * * * *

UNITED STATES PATENT AND TRADEMARK OFFICE

CERTIFICATE OF CORRECTION

PATENT NO. : 4,310,434

DATED : January 12, 1982

INVENTOR(S) : Clement K. Choy and Robert A. Greene

It is certified that error appears in the above-identified patent and that said Letters Patent are hereby corrected as shown below:

Column 6, line 17, after the "," and before "by" insert --- incorporated ---.

Column 6, line 53, after ";" and before "and" insert --- now abandoned in favor of U.S. Ser. No. 234,535 filed Feb. 17, 1981, ---.

Column 6, lines 54-55 delete --- now abandoned in favor of U.S. Ser. No. 234,535 filed Feb. 17, 1981, ---.

Signed and Sealed this

*Thirteenth* Day of *April 1982*

[SEAL]

*Attest:*

GERALD J. MOSSINGHOFF

*Attesting Officer*

*Commissioner of Patents and Trademarks*